US007152677B2

(12) United States Patent
Parlar et al.

(10) Patent No.: US 7,152,677 B2
(45) Date of Patent: Dec. 26, 2006

(54) METHOD AND GRAVEL PACKING OPEN HOLES ABOVE FRACTURING PRESSURE

(75) Inventors: Mehmet Parlar, Sugar Land, TX (US); Colin Price-Smith, Missouri City, TX (US); Raymond Tibbles, Kuala Lumpur (MY); Gary Hurst, Lake Jackson, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 339 days.

(21) Appl. No.: 10/344,584

(22) PCT Filed: Sep. 20, 2001

(86) PCT No.: PCT/US01/29393

§ 371 (c)(1),
(2), (4) Date: Aug. 11, 2003

(87) PCT Pub. No.: WO02/25058

PCT Pub. Date: Mar. 28, 2002

(65) Prior Publication Data

US 2004/0035579 A1 Feb. 26, 2004

(51) Int. Cl.
*E21B 43/04* (2006.01)
*E21B 43/26* (2006.01)

(52) U.S. Cl. ..... 166/278; 166/51; 166/308.1; 166/177.5

(58) Field of Classification Search ..... 166/278, 166/270.1, 271, 305.1, 51, 308.1, 227, 177.5
See application file for complete search history.

(56) References Cited

U.S. PATENT DOCUMENTS

| | | | | |
|---|---|---|---|---|
| 5,375,661 | A | 12/1994 | Dameshy et al. | 166/278 |
| 5,435,391 | A * | 7/1995 | Jones | 166/308.1 |
| 5,690,175 | A * | 11/1997 | Jones | 166/278 |
| 5,848,645 | A * | 12/1998 | Jones | 166/280.1 |
| 5,868,200 | A * | 2/1999 | Bryant et al. | 166/51 |
| 5,934,376 | A * | 8/1999 | Nguyen et al. | 166/278 |
| 6,230,803 | B1 | 5/2001 | Morton et al. | 166/278 |
| 6,298,916 | B1 * | 10/2001 | Tibbles et al. | 166/278 |
| 6,446,722 | B1 * | 9/2002 | Nguyen et al. | 166/278 |
| 6,644,406 | B1 * | 11/2003 | Jones | 166/308.1 |
| 2002/0189809 | A1 * | 12/2002 | Nguyen et al. | 166/278 |

OTHER PUBLICATIONS

Morton, B. et al, "Multi-Zone, Single-Trip Gravel Packs Speed Time To Production" Offshore, Petroleum Publishing Co. Tulsa, US, vol. 52, No. 11, Nov. 1, 1992.

* cited by examiner

*Primary Examiner*—Jennifer H. Gay
(74) *Attorney, Agent, or Firm*—Thomas O. Mitchell; Tim Curington; Robin Nava

(57) ABSTRACT

The present invention provides a method for gravel packing a open-hole wellbore having a filter cake, comprising pumping a gravel slurry into a first portion of an annulus between the wellbore and a screen, at a sufficient rate and pressure to form at least a first fracture and diverting the gravel slurry to a second portion of said annulus through alternate flowpaths while providing hydraulic isolation between the first and the second portion of said interval, thereby preventing flowback from said second portion to said first portion and resulting extension of the first fracture, and thereby forming a second fracture in said second portion of said interval.

8 Claims, 1 Drawing Sheet

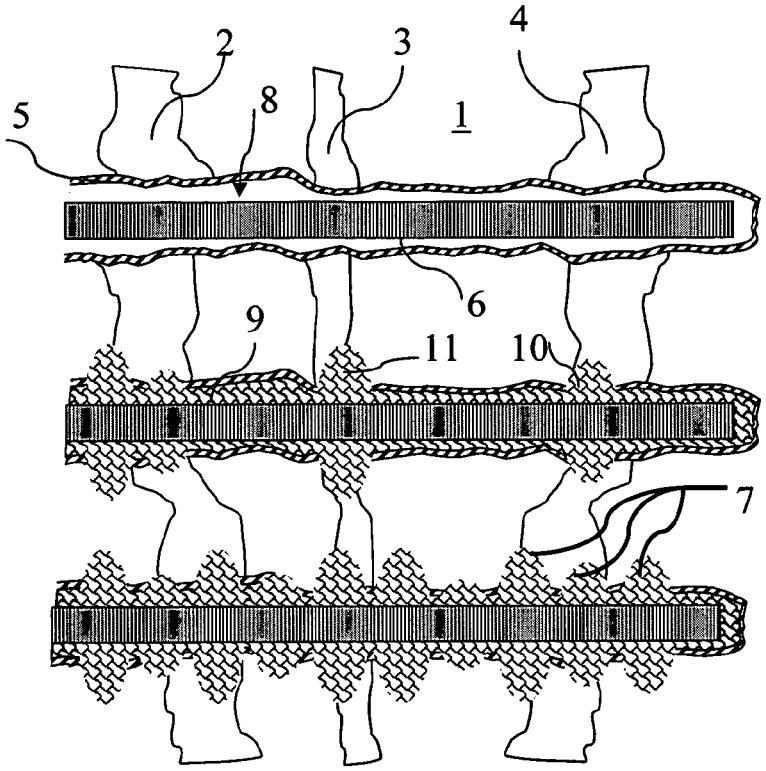
Fig. 1A
Fig. 1B
Fig. 1C
FIG. 1
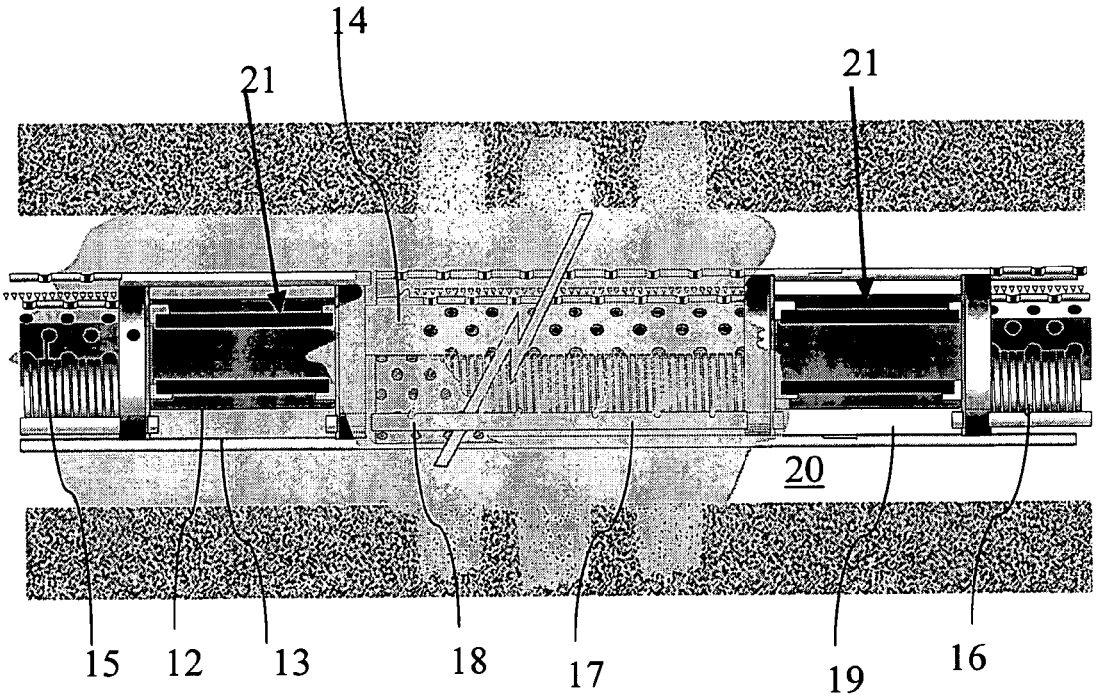
FIG. 2

METHOD AND GRAVEL PACKING OPEN HOLES ABOVE FRACTURING PRESSURE

TECHNICAL FIELD OF THE INVENTION

The present invention relates to the completion of hydrocarbon wellbore sand control, and more particularly to gravel-pack completion in horizontal or highly deviated open-hole wells.

BACKGROUND OF THE INVENTION

In the recovery of hydrocarbons from subterranean formations, horizontal or highly deviated wells are considered as a proven method of maximizing hydrocarbon productivity. Many horizontal or highly deviated wells are not cased and therefore the completion cost is small compared to cased-hole wells. In unconsolidated formations however, sand control measures need to be implemented to prevent wellbore collapse, and hardware failure, and to optimize well deliverability.

A very common practice in the oil and gas industry for controlling sand migration into wells penetrating loosely consolidated formations includes placement of gravel packs to hold formation sand in place. The gravel pack is typically deposited around a perforated liner or screen. The gravel pack filters the sand while still allowing formation fluids to flow through the gravel, the screen and a production pipe.

Highly deviated or horizontal wells are in most cases completed open-hole essentially because of higher well productivities and lower completion cost. In the past, such wells were typically completed with stand-alone screens so that the well will collapse around the screen. However the screen may be in some areas plugged by formation sand. Therefore, it might be desirable to protect the screen with a gravel pack that further stabilizes the formation face.

Consequently, gravel packing of open-hole horizontal wellbores is increasingly used for completing horizontal wells (in the remaining part of this document, the term "horizontal wells" is also meant to include highly deviated wells).

Typically, horizontal gravel packing is achieved with water packing. Water packing is a two-stage process using a low concentration of gravel in brine. In a first wave, called the $\alpha$ wave, the lower section of the well is packed until either the well extremity is reached or a premature screen-out occurs. The premature screen-out is due to the formation of a bridge due to increased leakoff rates and thus decreased return rates. Then, the top section of the well is packed by the second or $\beta$ wave. Water packing mainly relies on the ability to maintain high circulation rates. Indeed gravel transport essentially depends on velocity and turbulent flow rather than viscosity. Therefore the success of gravel placement relies on the existence of a low-permeability filter cake that minimizes losses of gravel packing fluids. As discussed in SPE paper 38640 presented at a symposium sponsored by the Society of Petroleum Engineers held in Rio de Janeiro, Brazil, during 30 Aug.–3 Sep. 1997, fracturing must be avoided at all costs in such an operation. Otherwise, a catastrophic loss of gravel-pack fluid occurs, resulting in the formation of bridges and incomplete packing below the bridge. Bearing in mind that intervals as long as 10,000 feet may have to be packed in horizontal wells, the formation of a bridge near the heel of the interval (the portion of the interval closest to the surface of the wellbore) could indeed result in a dramatic decrease of the well productivity.

To alleviate the difficulties raised by long or inclined intervals, "alternate path" tools have been proposed. Such tools include perforated shunts adapted to receive the gravel slurry as it enters the annulus around the screen. Those shunts provide alternate paths that allow the gravel slurry to be delivered even though a bridge forms before the operation is completed. A complete description of a typical alternate path gravel pack tool and how it operates can be found for instance in U.S. Pat. No. 4,945,991. Several improvements to the operational technique and to the tools have been proposed for instance in U.S. Pat. Nos. 4,945,991; 5,082,052; 5,113,935; 5,341,880; 5,419,394; 5,435,391; 5,476,143; 5,515,915 and 6,220,345. This technique has been successfully applied for horizontal wells.

Unlike water packing, gravel packing with the shunt technique proceeds from heel to toe, based on visual observations in large-scale yard tests (see for example, FIG. 3 in Journal of Petroleum Technology, January 2000, pp. 50–58). In fact, based on large-scale yard tests, packing with this technique takes place with successive formation of bridges as discussed in the JPT article referred to earlier. Furthermore, once a segment of screen/formation annulus and the shunt ports serving that section are packed, diversion of slurry into the next segment of shunt tubes occurs due to high resistance to flow through the packed shunt ports. Thus, the success of gravel packing with this technique is controlled by the resistance to slurry flow through the shunt ports, and is independent of either the formation properties or the existence of a filtercake. This has been proven repeatedly with field applications where gravel packing of long intervals has been accomplished without any returns, as also evidenced in large scale yard testing.

After the placement of the gravel, it is desirable to remove the filter cake formed during the drilling or cleaning process to achieve a uniform flow profile along the horizontal well and avoid premature aging of the screen. Cake clean-up has been conventionally done as a separate operation that involves pulling the work string out of the hole, running in with the production tubing, tripping in with coiled tubing in order to displace the remaining gravel pack carrier fluid and spotting of a breaker solution. This cleaning process is time consuming, costly and often of poor efficiency. It is therefore desirable to provide a new way of completing open hole wellbores.

SUMMARY OF THE INVENTION

This invention is a system and a process whereby gravel packing of open-hole completions can be done above fracturing pressure in order to bypass filtercake damage, where the latter is typically on the order of several millimeters to several inches. The proposed approach is significantly different from conventional fracturing and frac-packing techniques, where pad injection and high injection rates during both the pad and the slurry injection are required in order to keep the fracture open and thus maintain the fracture propagation.

The present invention provides a method for completing an interval of an open-hole wellbore penetrating a subterranean formation, said wellbore communicating with the formation by way of an interface that comprises at least a filter cake invaded zone, said method comprising locating a workstring in the sand screen inside the wellbore, thereby forming an annulus between the sand screen and the wellbore; pumping a gravel slurry into said annulus at a sufficient rate and pressure to form at least a first fracture in a first portion of said interval; and diverting the gravel slurry to at least a second portion of said annulus through alternate flowpaths while providing hydraulic isolation between the first and the second portion of said interval, thereby preventing flowback from said second portion to said first portion and resulting extension of the first fracture, and thereby forming a second fracture in said second portion of said interval.

The method of the present invention is mainly applicable to horizontal or highly deviated wells but could y also be applicable to all types of open-hole wells, though it is particularly appropriate for the completion of long intervals, extending for instance for over 300 feet and up to 1,500 feet or more if needed.

According to a preferred embodiment, at least three fractures are created. The operation will usually be designed to create as many fractures as possible over the interval. However, a key element of the invention is that those fractures are not designed to be wide and/or long.

Consequently, and unlike conventional fracturing or so called frac-and-pack techniques, the proposed technique does not involve pad stages or ramping of proppant concentration, but only requires that the fracture initiation pressure to be exceeded during pumping. In that regard it is worth noting that a treatment according to the invention will typically be designed to create a fracture of no more than a few inches. The pumping step will be conducted to provide fractures that, theoretically, extend radially outward form the wellbore no more than about 10 feet, preferably ranging between 3 and 100 inches, and most preferably between about 5 and about 50 inches. In that regard, it is worth noting that frac-and-pack operations are usually designed to create fractures from about 50 to about 100 feet.

Similarly, the fracture width is controlled so that it preferably ranges between 0 and ½ inch. Consequently, the total volume placement of gravel slurry is usually about twice the volume of the screen/wellbore annulus, and in most cases ranges between 1.5 and 2.5 times said volume.

The invention provides a number of benefits; namely it eliminates the need for cake removal treatment and the associated risks of damaging the sand screen, in particular when aggressive filter cake breakers such as those based on hydrochloric acid are used. Gravel packing above formation pressure provides a way to by-pass external filter cakes that would not have been removed by any cleanup fluids, by-pass internal filter cake damage, reduce overall drilling and completion costs while maximizing well productivity, improving well life as a result of a reduced potential for plugging due to increased surface areas, and improving production/injection profiles through selective fracing of low permeability sections or stimulation of flow constrained hole sections (i.e. toes of horizontal wells).

BRIEF DESCRIPTION OF THE DRAWINGS

Other and further objects, features and benefits of the present invention will be further understood by referring to the drawings in which:

FIG. 1 is a conceptual schematic for open-hole shunt-packing of horizontal wells above the fracturing pressure according to the invention; and FIG. 2 is a schematic, partly in section view, of a portion of an alternate-path tool in an operable configuration within an open-hole wellbore as a gravel fluid is being flowed according to the invention to create a first fracture.

DETAILED DESCRIPTION OF PREFERRED EMBODIMENTS

The proposed technique pertains to open-hole completions drilled with a drilling fluid that forms a filtercake, and it involves placing the gravel in a viscosified slurry with the service tool in the squeeze position using alternate path/shunt screens. The drilling fluid can be either water-based or synthetic/oil-based; however, it is preferably a reservoir drilling fluid so that the filter cake is thin and contains a relatively small amount of fines and, from the standpoint of long-term migration of drill solid fines into the pack of the formation, the smaller the amount of fines downhole, the better.

The success of gravel placement with the proposed technique relies on the existence of a low permeability filter cake that keeps fluid loss to a minimum so that dehydration against the formation does not occur until the fracturing pressure is reached and a small fracture penetrates the filter cake and the formation. The method of the present invention deliberately omits the injection of a solid-free fluid or "pad" above fracturing pressure before injecting the gravel slurry. Similarly, no ramped fracturing operation is performed. The idea is to minimize leakoff in the fracture that would cause the gravel/proppant to bridge off and divert the slurry to another section of the open hole without properly packing the created fracture.

The gravel slurry for use in accordance with the present invention is comprised of a gelled base and gravel. The term "gravel" shall be understood as including any particulate material such as sand, bauxite, or ceramic beads, including resin coated. The size of the gravel should be selected based on conventional criteria; generally, a gravel having a size ranging between 20 and 40 mesh (U.S. Standard Sieve Series) is preferred. The carrier fluid may be either an aqueous (water or brine) or an oil-base fluid. A variety of known gelling agents can be added to an aqueous base, including natural or synthetic gums such as guar, polysaccharides, in particular galactomannan gums, polymers such as polyacrylamides, biopolymers such as xanthan and cellulose derivative materials. Modified celluloses and derivatives thereof, in particular "clean" polymers such as cross-linked hydroxyalkyl cellulose and carboxymethylcellulose are of particular interest.

Aqueous fluids can also be gelled using viscoelastic surfactants, for instance based upon cationic surfactants such as erucyl methyl bis(2-hydroxyethyl)ammonium chloride (hereinafter referred to as "EMHAC") and zwitterionic surfactants such as betaine surfactants. Carrier fluids gelled with viscoelastic surfactants are polymer-free and therefore less likely to damage the oil reservoir. Moreover, viscoelastic surfactant fluids help to further increase the resistance to leak-off into the fractured section as explained in U.S. Pat. No. 5,551,516, Hydraulic Fracturing Process and Compositions, U.S. Pat. No. 5,964,295, Methods of Fracturing Subterranean Formations, and U.S. Pat. No. 5,979,557, Methods for Limiting the Inflow of Formation Water and for Stimulating Subterranean Formations, all hereby incorporated by reference. Viscoelastic fluids also contribute to reducing the friction pressure, a point of particular interest since the carrier fluid has to be conveyed along long intervals of pipes of reduced diameter.

In contrast to conventional fracturing, the fluid density of the carrier fluids used in accordance with the present invention should typically be higher to maintain well stability prior to and during the fracturing process at a relatively low injection rate.

At any time during the whole completion operation, the slurry is generally pumped at a well head pressure of less than 1000 psig. Again, this is significantly different from frac-and-pack techniques that involve a step of fracturing at a well head pressure up to 5000 psig or even higher. During gravel placement, the service tool is in the squeeze position or annulus closed. The injection rate typically ranges between 2 and 5 barrels per minute (bpm), with a solid concentration typically not exceeding 2 ppa.

The fracturing process involved in the invention is illustrated in FIG. 1. After drilling, an interval of a well to be completed (see FIG. 1A) penetrates a formation 1 that comprises some shale zones 2, 3 and 4 that are likely to facilitate the formation of bridges. The interface between the wellbore and the formation comprises a zone 5 invaded by a filter cake. A screen 6 is located in the wellbore so that it defines an annulus 8.

As seen in FIG. 1B, a gravel slurry 9 is pumped within the annulus 8 at a pressure slightly exceeding the formation pressure. Fractures 10, 11 will initially be formed into shales. The use of reduced injection rate might be sufficient to limit the previously fractured section through annular packing and promote a subsequent fracture initiation point once the rate (and thus pressure) is increased.

Once small propped fractures have been created, thanks to the alternate path technology that allows transport of the gravel slurry through bridges, multiple fractures 12 along the wellbore may be achieved (FIG. 1C) if there is a sufficient degree of isolation of the wash-pipe/base-pipe annulus at selected intervals.

In practice, this degree of isolation might be achieved by adding joints to the gravel pack string as illustrated in FIG. 2. The method of the invention is typically carried out with an alternate path tool that comprises a wash pipe. As mentioned earlier, alternate path tools are well known and complete descriptions of their construction and operation can be found in the public literature, therefore the schematic concentrates on some new aspects of the invention.

A typical workstring is comprised of a base pipe 12, which is positioned within an outer pipe or shroud 13. The shroud comprises perforated sections. The base pipe and the shroud are usually concentric but may also be off-center. The workstring further comprises a wash pipe 14. In operation, the wash pipe and the base pipe are fluidly connected to the surface so that two different fluids can be delivered to the well interval.

The base pipe comprises perforated sections 15 covered by a sand screen 16. It further comprises one or more shunt tubes 17 radially spaced around the sand screen. Each shunt tube comprises openings 18, or preferably at least injectors, which provide alternate flowpaths.

This arrangement defines a first annulus 19 between the shroud and the base pipe and a second annulus 20 between the shroud and the wellbore. According to a preferred embodiment of the present invention, the first annulus is divided into discrete sections through the placement of joints 21, for instance PBRs, in the screen assembly and seals on the wash pipe.

In cases where creating fractures above a certain point (e.g., near the heel section of an openhole horizontal well) may be undesirable, a perforated wash pipe can be used to gravel pack the upper sections and induce fractures in the lower sections.

The invention claimed is:

1. A method for completing an interval of an open-hole wellbore penetrating a subterranean formation, said wellbore being in communication with said formation by way of an interface that comprises at least a filter cake invaded zone, said method comprising:

a) locating a workstring inside said wellbore, said workstring comprising a wash pipe within a base pipe within a shroud, said workstring comprising more than one treatment section separated by at least one isolation section, wherein in said treatment sections said base pipe comprises a perforated section covered by a sand screen allowing fluid access to said wash pipe, said wash pipe and said shroud in said treatment sections being perforated, said treatment sections further comprising one or more shunt tubes having openings, said treatment sections separated by at least one isolation section, wherein in said at least one isolation section fluid communication is not allowed between said wash pipe, said base pipe, and said shroud, thereby forming first annulus between said shroud and said wellbore and a second annulus between said shroud and said base pipe, said first annulus being continuous adjacent said workstring, said second annulus comprising isolated sections in fluid communication with one another through said one or more shunt tubes;

b) pumping a gravel slurry into said first annulus at a sufficient rate and pressure to form at least a first fracture in a first portion of said interval adjacent a first treatment section;

c) diverting said gravel slurry to at least a second portion of said interval adjacent a second treatment section through said one or more shunt tubes in said first and second treatment sections, while providing hydraulic isolation in said second annulus between said first and said second treatment sections except through said one or more shunt tubes, thereby preventing flowback of said gravel slurry from said second portion to said first portion resulting in extension of said first fracture, and thereby forming a second fracture in said second portion of said interval.

2. The method of claim 1, comprising repeating step c) at least once.

3. The method of claim 2, wherein the length of the completion interval is at least 300 feet.

4. The method of claim 1, wherein the wellbore is horizontal or highly deviated.

5. The method of claim 4, wherein the viscous base comprises a viscoelastic surfactant.

6. The method of claim 1, wherein the gravel slurry comprises a viscous base.

7. The method of claim 1, wherein the first and second fracture extend radially outward from the wellbore a distance within 3 to 150 inches.

8. The method of claim 1, wherein the total volume placement of gravel slurry is about within a range of 150% and 250% of the first annulus between the shroud and the wellbore.

* * * * *